United States Patent [19]

Hickey

[11] Patent Number: 4,714,985

[45] Date of Patent: Dec. 22, 1987

[54] TRICK-OR-TREAT CARRIER WITH FALSE BOTTOM

[76] Inventor: Charles P. Hickey, 1904-27 St., Monroe, Wis. 53566

[21] Appl. No.: 30,506

[22] Filed: Mar. 26, 1987

[51] Int. Cl.[4] ..... F21V 33/00

[52] U.S. Cl. ..... 362/154; 362/223

[58] Field of Search ..... 362/154, 186; 150/50

[56] References Cited

U.S. PATENT DOCUMENTS

| | | | |
|---|---|---|---|
| 1,208,445 | 12/1916 | Arnold | 150/50 |
| 1,289,410 | 12/1918 | Day | 150/50 |
| 2,428,133 | 7/1946 | Yogan | 362/186 |
| 3,258,589 | 6/1966 | Doring | 362/154 |

*Primary Examiner*—E.Rollins Cross

*Attorney, Agent, or Firm*—Andrus, Sceales, Starke & Sawall

[57] ABSTRACT

A carrier is provided which comprises a generally bucket-shaped translucent container (2) having an open top for collection of items, and which may have a handle if desired. A light cource (9) is positioned within the container adjacent the bottom wall thereof. A light deflector (15) is removably positioned above the light source and also serves as a false bottom for receiving collected items. The deflector is spaced from the container bottom wall to form a light-bouncing chamber (20) therebetween; and furthermore is slideable upwardly within the container for easy removal of the collected items. The light source provides an access handle (10) for grasping and removing the deflector and its collected contents upwardly. Furthermore, the container bottom wall (5) includes an opening (12) through which light from the light source passes downwardly to assist in lighting the way of the user. In addition, a raised rim (14) surrounding the opening serves to mount the light source. Also, the deflector is translucent and preferably of a lighter color than the container itself to maximize light reflectivity. In a further embodiment, (FIG. 5), the deflector is springingly held in position by the container side wall.

9 Claims, 5 Drawing Figures

TRICK-OR-TREAT CARRIER WITH FALSE BOTTOM

PRIOR ART OF INTEREST

| U.S. Pat. No. | Inventor | Issue Date |
|---|---|---|
| 1,208,445 | Arnold | December 12, 1916 |
| 1,289,410 | Day | December 31, 1918 |
| 2,428,133 | Yogan | September 30, 1947 |
| 3,258,589 | Doring | June 28, 1966 |

BACKGROUND AND SUMMARY OF THE INVENTION

This invention relates to a carrier for trick-or-treating or the like, with the carrier having a false bottom. The invention is considered to be an improvement over my copending application Ser. No. 796,964 filed Nov. 12, 1985 and entitled "CARRIER FOR TRICK-OR-TREATING OR THE LIKE". In that application, a generally bucket-shaped container has a bottom having an opening for receiving a light source, such as a flashlight, therethrough for use of the carrier in darkness. The light source is held in position within the opening and may face up or down as desired. Small children collect items by going from door-to-door and placing the items in the container. In one embodiment, a pair of containers are joined at their bottom portions.

The above identified prior art of interest discloses a number of known devices. The patents to Arnold and Day disclose a collapsible bucket having a hole in its bottom. Yogan discloses a pumpkin-shaped toy having a light source mounted on an interior side wall. Finally, Doring discloses a fold-up novelty pumpkin for attachment to the end of a flashlight.

It is an object of the invention to provide a carrier which makes it easier for children to retrieve collected items therefrom, while at the same time lighting up the carrier for maximum visibility and spooky effect in the dark.

In accordance with the various aspects of the invention, and in the broadest sense, a carrier is provided which comprises a generally bucket-shaped translucent container having an open top for collection of items, and which may have a handle if desired. A light source is positioned within the container adjacent the bottom wall thereof. A light deflector is removably positioned above the light source and also serves as a false bottom for receiving collected items. The deflector is spaced from the container bottom wall to form a light-bouncing chamber therebetween; and furthermore is slideable upwardly within the container for easy removal of the collected items.

In accordance with the various aspects of the main embodiment shown, the light source provides an access handle for grasping and removing the deflector and its collected contents upwardly. Furthermore, the container bottom wall includes an opening through which light from the light source passes downwardly to assist in lighting the way of the user. In addition, a raised rim surrounding the opening serves to mount the light source. Also, the deflector is translucent and preferably of a lighter color than the container itself to maximize light reflectivity. In a further embodiment, the deflector is springingly held in position by the container side wall.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENTS

Figure 1:
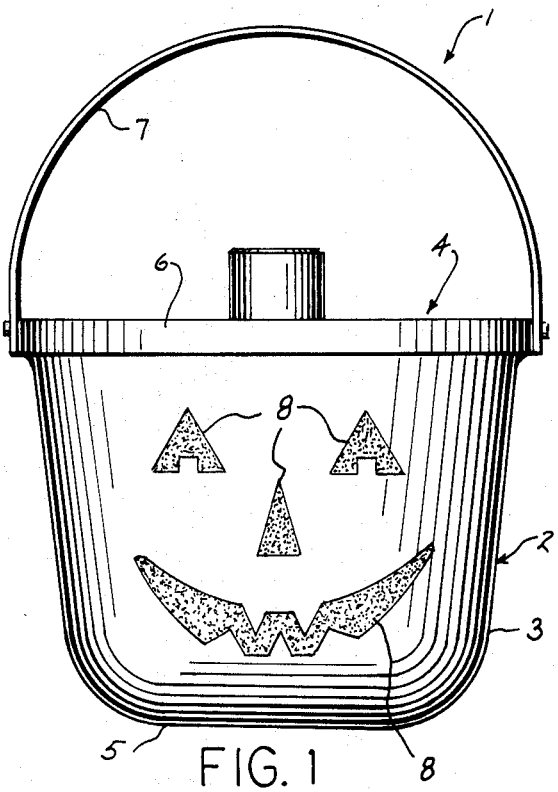
FIG. 1 is a front elevation of a carrier constructed in accordance with the various aspects of the invention.

As shown in the drawings, a carrier 1 for trick-or-treating or the like is provided which comprises a unitary bucket-like container 2 having a generally cylindrical side wall 3 which tapers slightly between an open top portion 4 and a generally flat bottom wall 5. The upper end of side wall 3 may be provided with a thickened rim 6 to which is attached, as by a suitable snap-on arrangement, an arcuate carrying handle 7. Container 2 is preferably made of light-weight molded translucent plastic, such as polyethylene, and is preferably colored orange and provided with face-like decorations 8 to emulate a Halloween pumpkin. The interior of container 2 is adapted to receive trick-or-treat or other items dumped in through its top.

Container 2 is adapted to function in conjunction with a light source which may light the way for the user, and which causes the walls of the carrier to glow from the interior thereof. For this purpose, the light source is disposed within container 2 adjacent bottom wall 5 thereof. In the present embodiment, the light source comprises a flashlight 9 having an elongated body portion 10 for containing batteries, and a lens ring 11 which is removably attachable to body portion 10, as by threading, and which contains the usual bulb and reflector, not shown. The walls of lens ring 11 are contemplated as being translucent.

Container bottom wall 5 is provided with means for receiving and generally centering a downwardly facing flashlight 9 thereon, as well as opening means for permitting a portion of the light to freely pass therethrough and outwardly of the carrier. For this purpose, and in the present embodiment, bottom wall 5 is provided with an opening 12 which is traversed by light transmissive rib-like cross members 13 molded into the container and integrally connected to wall 5 so that light is transmitted outwardly from the opening and through the container. Opening 12 is shown as being circular with a raised annular rim 14 therearound in bottom wall 5 which extends into the carrier. Rim 14 is adapted to receive lens ring 11 thereon, as will be described.

Figure 4:
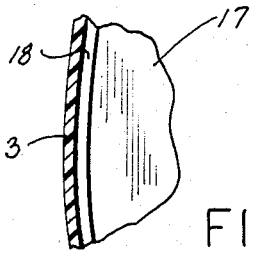
FIG. 4 is an enlarged sectional view taken on line 4—4 of FIG. 2.

In accordance with various aspects of the present invention, means are disposed within container 2 to not only removably hold collected items therewithin, but also to enhance glowing of the carrier when flashlight 9 is activated. For this purpose, a generally dish-shaped deflector 15 is provided which includes a bottom portion 16 which merges into an annular side wall 17 which in turn inclines upwardly and outwardly and terminates in an upper edge 18 which may engage container side wall 3. See FIGS. 2 and 4. An opening 19 in deflector bottom portion 16 is adapted to have its edge clamped between flashlight body 10 and lens ring 11 by screwing the latter onto body 10 with the deflector therebetween.

Flashlight 9 and deflector 15 form an assembly which is lowered into container 2 until lens ring 11 mountingly fits over and is centered by raised rim 14. Lens ring 11 functions to space deflector 15 above container bottom wall 5, thus forming a light deflecting chamber 20 within which light emanating from flashlight 9 bounces around between the varous surfaces as shown by the arrows. The glowing effect of this construction can be enhanced by forming deflector 15 from suitable white translucent plastic which is of greater reflectivity then the orange container. Furthermore, the light transmissivity of container 2 causes light from chamber 20 to pass up through side wall 3 so that the upper part of carrier 1 glows as well.

Figure 5:
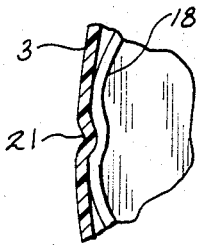
FIG. 5 is a view similar to FIG. 4, and illustrating another embodiment.
Figure 3:
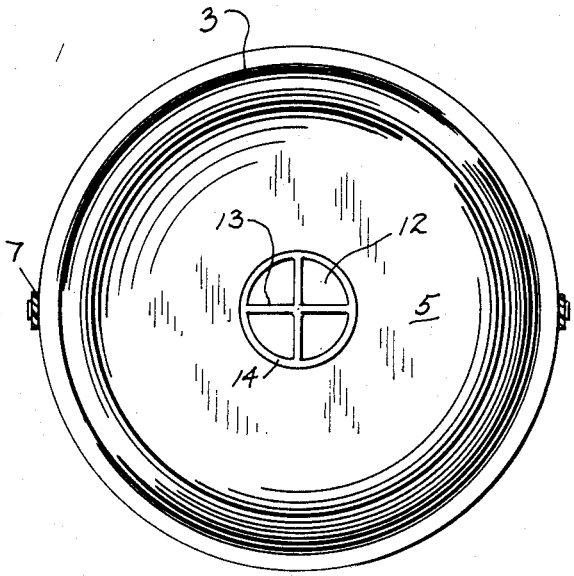
FIG. 3 is a top plan view of the carrier with the deflector removed.

The general dish shape of deflector 15 is such as to form a false bottom in the carrier which is adapted to storingly receive items collected by the user. Deflector edge 18 should preferably be disposed closely adjacent or in contact with container side wall 3. FIG. 5 illustrates an embodiment wherein side wall 3 is formed with vertical ridge means 21, in the manner of a pumpkin, which extend inwardly into springing deforming biasing engagement with deflector edge 18, thereby providing a friction fit therebetween to hold deflector 15 against unintentional sliding movement.

Figure 2:
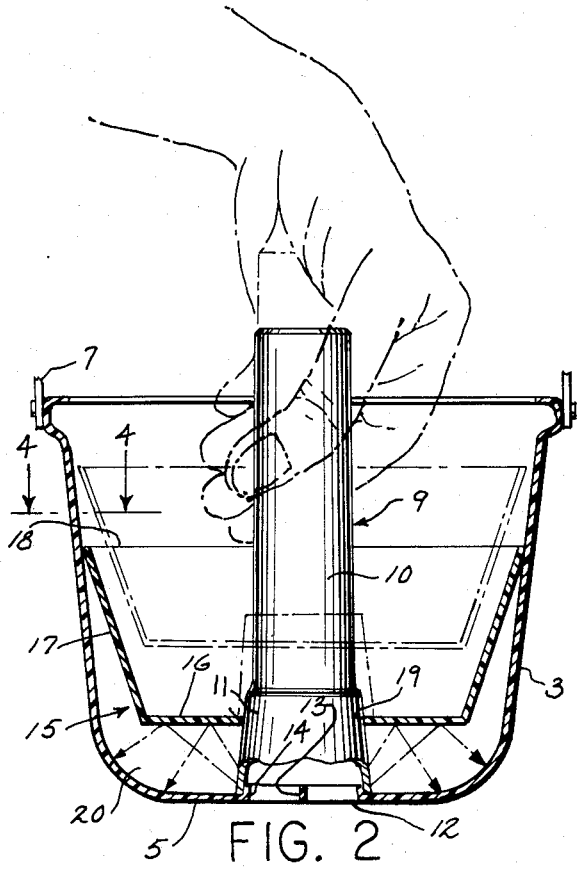
FIG. 2 is a vertical sectional view of the carrier, showing removability of the deflector.

Certain aspects of the invention contemplate handle means associated with deflector 15 for removing the latter upwardly from container 2, which simultaneously removes the collected items from the container. In the present embodiment, flashlight body 10 serves as the handle means, as shown in FIG. 2.

The various concepts disclosed herein provide a unique and appealing carrier for young children in trick-or-treating or the like. The carrier is of simple construction and is relatively inexpensive to manufacture.

Various modes of carrying out the invention are contemplated as being within the scope of the following claims particularly pointing out and distinctly claiming the subject matter which is regarded as the invention.

I claim:

1. A carrier for use wherein a number of items are to be collected and carried in darkness, said carrier comprising, in combination:

(a) a unitary carryable bucket-like container (2) having an open top (4), a side wall (3) and a bottom wall (5), (b) a light source (11) disposed within said container adjacent said bottom wall, (c) and a false bottom member (15) removably disposed within said container and spaced from said bottom wall to form a light deflecting chamber (20), (d) said false bottom member forming means to storingly receive collected items, and to carry said items out of said carrier when said false bottom member is removed from said container.

2. The carrier of claim 1 in which said container (2) and said false bottom member (15) are made of translucent material with said false bottom member being more light reflective than said container.

3. The carrier of claim 1 which includes handle means (10) associated with said light source (11) for lifting said false bottom member (15) out of said container.

4. The carrier of claim 3 in which:

(a) said light source comprises a flashlight (9) attached to said false bottom member (15) and having an elongated body (10), (b) said body (10) comprising said handle means.

5. The carrier of claim 1 which includes: opening means (12) disposed in said container bottom wall (5) for permitting free transmission of light from said chamber (20) to the exterior of said carrier.

6. The carrier of claim 5:

(a) in which said container (2) is made of light translucent material, (b) and means (13) disposed in said opening means (12) and forming an integral part of said container for transmitting light from said light source outwardly from said opening means and through said container.

7. The carrier of claim 5 which includes means (14) for mounting said light source adjacent said opening means (12).

8. The carrier of claim 7:

(a) in which said light source comprises a flashlight (9) having an elongated body (10) and a lens ring (11), (b) and said mounting means comprises a raised rim (14) disposed on said container bottom wall (5) over which said lens ring fits.

9. The carrier of claim 1 in which said container side wall (3) forms spring means (21) biasingly engageable with said false bottom member (15) to hold the latter in place.

* * * * *